US007350239B1

(12) United States Patent
Rosenzweig

(10) Patent No.: US 7,350,239 B1
(45) Date of Patent: Apr. 1, 2008

(54) CLOTHES PROTECTION SYSTEM

(76) Inventor: Leo Rosenzweig, 45 Katherine Blvd., Apt. 511, Palm Harbor, FL (US) 34684

( * ) Notice: Subject to any disclaimer, the term of this patent is extended or adjusted under 35 U.S.C. 154(b) by 0 days.

(21) Appl. No.: 11/888,711

(22) Filed: Aug. 2, 2007

(51) Int. Cl.
*A41B 13/10* (2006.01)

(52) U.S. Cl. ..... 2/49.1; 2/52

(58) Field of Classification Search ..... 2/49.1, 2/52, 48, 49.2–49.5, 46, 50, 51, 88, 114, 104, 2/74, 75, 79, 111, 89, 80, 83, 85, 207, 908, 2/913; D2/860–864, 718–720, 826; 128/849, 128/853, 854, 872
See application file for complete search history.

(56) References Cited

U.S. PATENT DOCUMENTS 1,133,194 A * 3/1915 Sylvie ..... 2/50
1,511,737 A * 10/1924 Lord ..... 2/50
2,440,666 A * 4/1948 Miller ..... 2/49.2
2,698,944 A * 1/1955 Ramsby ..... 2/174
4,547,907 A * 10/1985 Netsky ..... 2/114
4,884,299 A * 12/1989 Rose ..... 206/390
5,709,000 A * 1/1998 Hansen et al. ..... 5/655
6,272,888 B1 * 8/2001 Fujita et al. ..... 2/111
6,345,392 B1 * 2/2002 Rios ..... 2/48
6,374,411 B1 * 4/2002 Duhn ..... 2/49.1
6,799,330 B1 10/2004 Lansdell
7,181,771 B1 * 2/2007 Naehu ..... 2/49.1
2001/0047532 A1 12/2001 Marrero

* cited by examiner

*Primary Examiner*—A. Vanatta

(57) ABSTRACT

A flexible sheet has a front and a back surface. The sheet also has a top, a bottom and two sides edges. A neck hole has a lower most extent and an upper most extent. A slit is provided in a diagonal orientation. The slit extends from the lower most extent of the hole to one side edge. In this manner an angle of between about 20 and 40 degrees from the horizontal is formed. A fastening assembly includes a superior and an inferior strip. Each strip has an inner face and an outer face with Velcro elements. The inferior strip is secured to the exterior surface of the sheet adjacent to the upper edge of the slit. The superior strip is secured to the interior surface of the sheet adjacent to the lower edge of the slit.

6 Claims, 2 Drawing Sheets

FIG 2
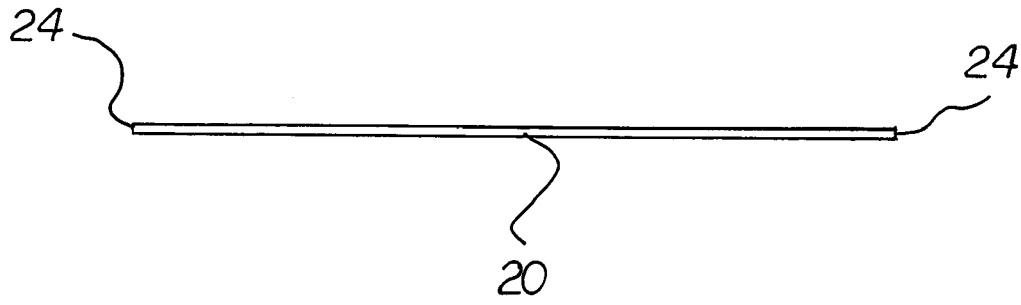
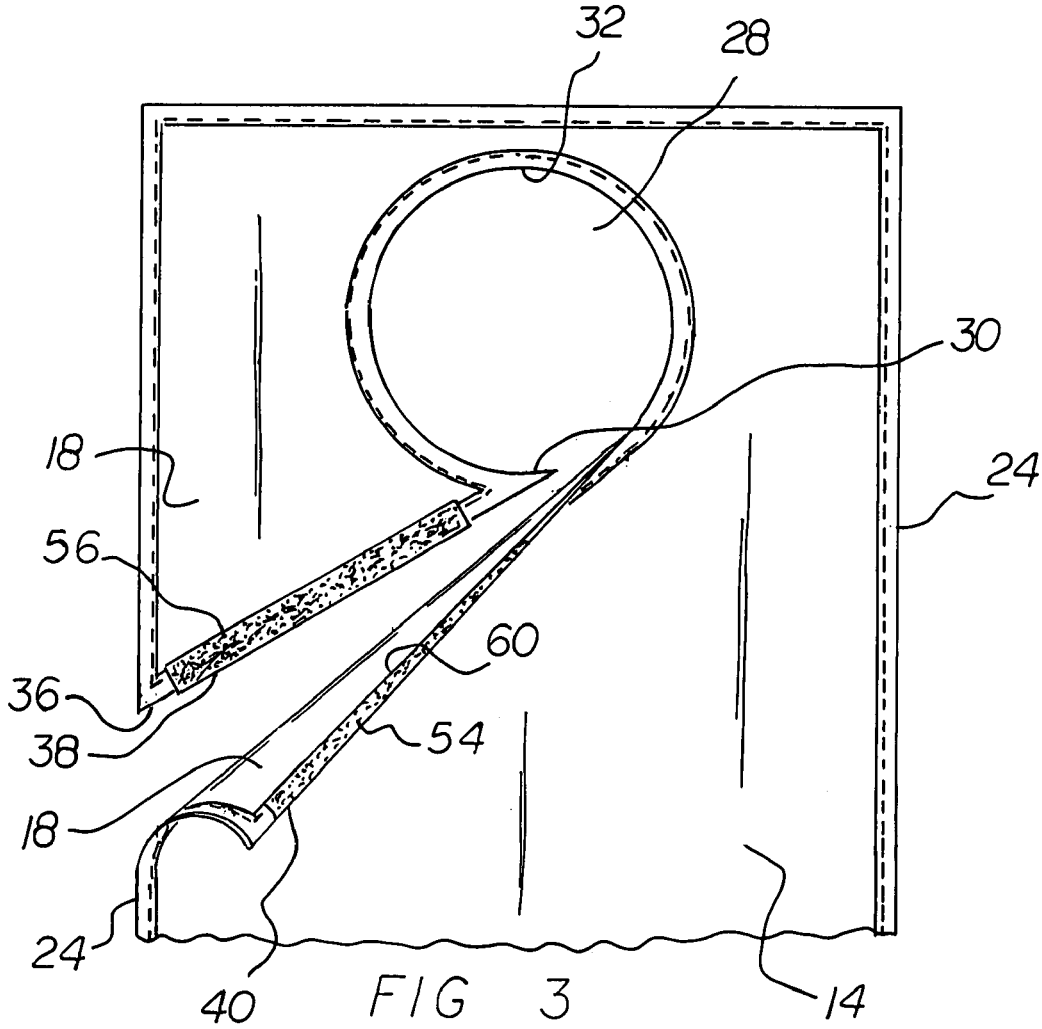
FIG 3

CLOTHES PROTECTION SYSTEM

BACKGROUND OF THE INVENTION

1. Field of the Invention

The present invention relates to a clothes protection system and more particularly pertains to keeping apparel of a wearer clean while eating in a safe, efficient and cost effective manner.

2. Description of the Prior Art

The use of clothes protection systems of known designs and configurations is known in the prior art. More specifically, clothes protection systems of known designs and configurations previously devised and utilized for the purpose of protecting clothing while eating through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,799,330 issued Oct. 5, 2004 to Lansdell relating to an Infant Bib and U.S. Patent Application Publication Number 2001/0047532 published Dec. 6, 2001 to Marrero relating to a Disposable Bib.

While these devices fulfill their respective, particular objectives and requirements, the aforementioned patents do not describe a clothes protection system that allows for keeping apparel of a wearer clean while eating in a safe, efficient and cost effective manner.

In this respect, the clothes protection system according to the present invention substantially departs from the conventional concepts and designs of the prior art, and in doing so provides an apparatus primarily developed for the purpose of keeping apparel of a wearer clean while eating.

Therefore, it can be appreciated that there exists a continuing need for a new and improved clothes protection system which can be used for independently keeping apparel of a wearer clean while eating. In this regard, the present invention substantially fulfills this need.

SUMMARY OF THE INVENTION

In view of the foregoing disadvantages inherent in the known types of clothes protection systems of known designs and configurations now present in the prior art, the present invention provides an improved clothes protection system. As such, the general purpose of the present invention, which will be described subsequently in greater detail, is to provide a new and improved clothes protection system and method which has all the advantages of the prior art and none of the disadvantages.

To attain this, the present invention essentially comprises a clothes protection system. First provided is a flexible, preferably washable sheet. The sheet is in a rectangular configuration. The sheet has a front surface. The sheet has a back surface. The sheet also has a horizontal top edge. The sheet has a parallel bottom edge. The top and bottom edges are spaced apart at a height. The height is about 36 inches. The sheet has two parallel vertical sides edges. The side edges extend between the top and the bottom edges. The side edges are spaced apart at a width. The width is about 18 inches. The sheet is fabricated of a flexible, preferably washable sheet.

A neck hole is provided. The neck hole is in a circular configuration. The neck hole has a diameter. The diameter is about 6 inches. The neck hole has a lower most extent. The lower most extent is located about 8 inches from the top edge. The neck hole upper most extent. The upper most extent is located about 2 inches from the top edge. The neck hole is centered between the two sides edges.

Provided next is a slit. The slit is in a diagonal orientation. The slit extends from the lower most extent of the hole to one side edge about 15 inches from the top edge. The slit forms an upper edge. The slit further forms a lower edge. The slit and its edges form an angle. The angle is about 30 degrees from the horizontal top and side edges.

Further provided is edging. The edging includes an exterior edging. The exterior edge covers the front and back surfaces around the entire periphery of the sheet. The periphery of the sheet covered by the exterior edging includes the top and bottom and side edges. The edging includes stitching. The stitching secures the exterior edging to the sheet. The edging also includes an interior edging. The interior edge covers the front and back surfaces around the entire neck hole and slit. The interior edging further includes stitching. The stitching secures the interior edging to the sheet.

Provided last is a fastening assembly. The fastening assembly includes two Velcro hook and loop fastening strips. Velcro is a trademark of Velcro Industries of Netherlands with an Office in Curacao, Netherlands. The two Velcro strips include a superior strip and an inferior strip. Each strip has an inner face with stitching. Each strip has an outer face with Velcro elements. The inferior strip is stitched to the front surface of the sheet adjacent to the lower edge of the slit. The superior strip is stitched to the back surface of the sheet adjacent to the upper edge of the slit. In this manner, the fastening mechanism is in front of the user to ensure self wearing.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved clothes protection system which may be easily and efficiently manufactured and marketed.

It is further object of the present invention to provide a new and improved clothes protection system which is of a durable and reliable construction.

An even further object of the present invention is to provide a new and improved clothes protection system which is susceptible of a low cost of manufacture with regard to both materials and labor, and which accordingly is then susceptible of low prices of sale to the consuming public, thereby making such clothes protection system economically available to the buying public.

Lastly, it is an object of the present invention to provide a new and improved clothes protection system. A flexible sheet has a front and a back surface. The sheet also has a top, a bottom and two sides edges. A neck hole has a lower most extent and an upper most extent. A slit is provided in a diagonal orientation. The slit has an upper and lower edge and extends from the lower most extent of the hole to one side edge. In this manner an angle of between about 20 and 40 degrees from the horizontal is formed. A fastening assembly includes a superior and an inferior strip. Each strip has an inner face and an outer face with Velcro elements. The inferior strip is secured to the exterior surface of the sheet adjacent to the upper edge of the slit. The superior strip is secured to the interior surface of the sheet adjacent to the lower edge of the slit.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a plan view of the system taken along line 2-2 of FIG. 1.

FIG. 3 is a rear elevational view of the upper portion of the clothes protector system illustrated in FIG. 1 but in the open orientation.

The same reference numerals refer to the same parts throughout the various Figures.

DESCRIPTION OF THE PREFERRED EMBODIMENT

Figure 1:
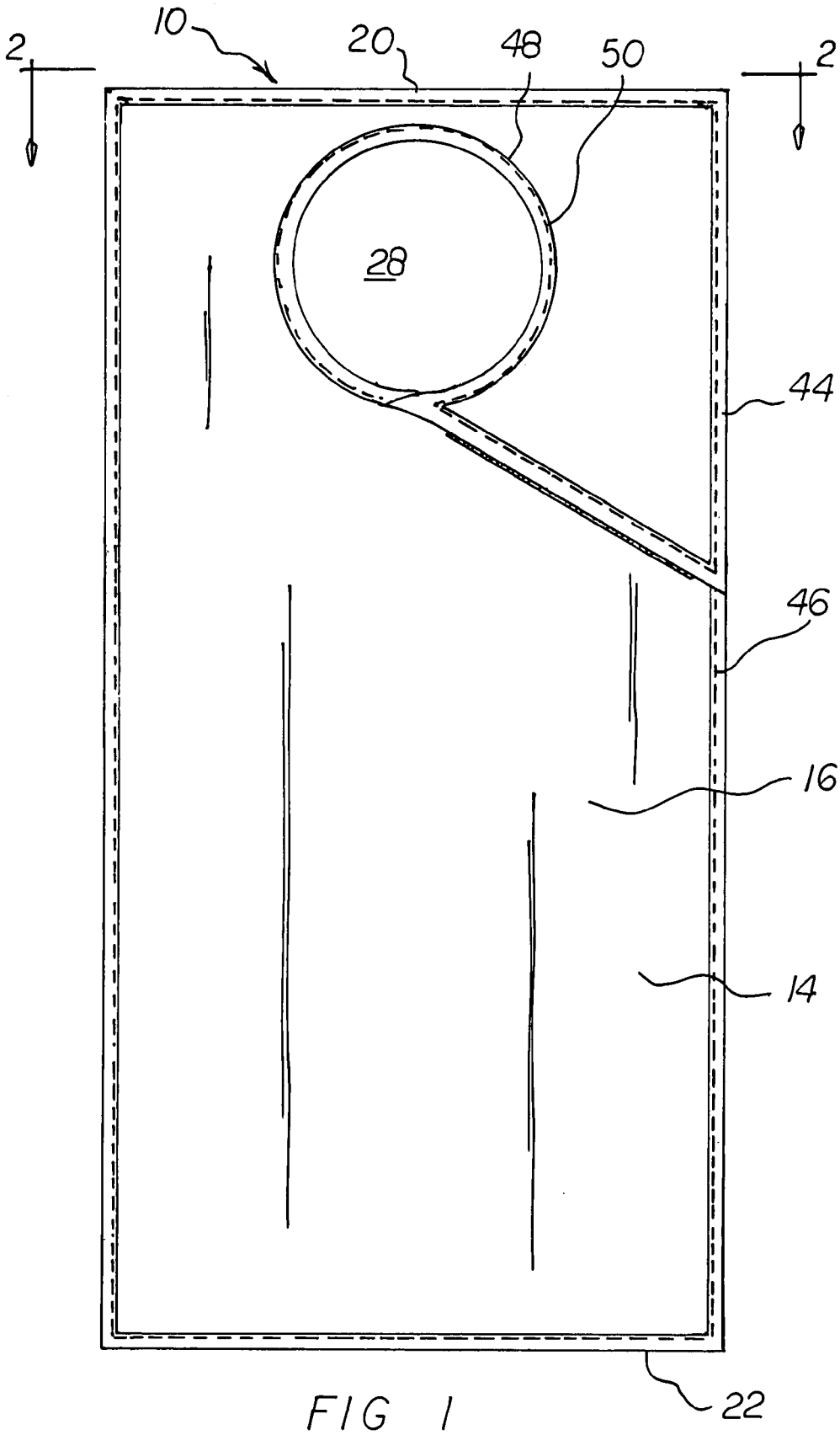
FIG. 1 is a front elevational view of a clothes protector system constructed in accordance with the principles of the present invention.

With reference now to the drawings, and in particular to FIG. 1 thereof, the preferred embodiment of the new and improved clothes protection system embodying the principles and concepts of the present invention and generally designated by the reference numeral 10 will be described.

The present invention, the clothes protection system 10 is comprised of a plurality of components. Such components in their broadest context include a flexible, preferably washable sheet, a neck hole, a slit and a fastening assembly. Such components are individually configured and correlated with respect to each other so as to attain the desired objective.

First provided is a flexible, preferably washable sheet 14. The sheet is in a rectangular configuration. The sheet has a front surface 16. The sheet has a back surface 18. The sheet also has a horizontal top edge 20. The sheet has a parallel bottom edge 22. The top and bottom edges are spaced apart at a height. The height is about 36 inches. The sheet has two parallel vertical sides edges 24. The side edges extend between the top and the bottom edges. The side edges are spaced apart at a width. The width is about 18 inches. The sheet is fabricated of a flexible, preferably washable material.

A neck hole 28 is provided. The neck hole is in a circular configuration. The neck hole has a diameter. The diameter is about 6 inches. The neck hole has a lower most extent 30. The lower most extent is located about 8 inches from the top edge. The neck hole upper most extent 32. The upper most extent is located about 2 inches from the top edge. The neck hole is centered between the two sides edges.

Provided next is a slit 36. The slit is in a diagonal orientation. The slit extends from the lower most extent of the hole to one side edge about 15 inches from the top edge. The slit forms an upper edge 38. The slit further forms a lower edge 40. The slit and its edges form an angle. The angle is about 30 degrees from the horizontal upper and lower edges.

Further provided is edging. The edging includes an exterior edging 44. The exterior edging covers the front and back surfaces around the entire periphery of the sheet. The periphery of the sheet covered by the exterior edging includes the top and bottom and side edges. The edging includes stitching 46. The stitching secures the exterior edging to the sheet. The edging also includes an interior edging 48. The interior edging covers the front and back surfaces around the entire neck hole and slit. The edging further includes stitching 50. The stitching secures the exterior edging to the sheet.

Provided last is a fastening assembly. The fastening assembly includes two Velcro strips 54, 56. The two Velcro strips include a superior strip 54 and an inferior strip 56. Each strip has an inner face with stitching 58. Each strip has an outer face with Velcro elements 60. The inferior strip is stitched to the front surface of the sheet adjacent to the lower edge of the slit. The superior strip is stitched to the back surface of the sheet adjacent to the upper edge of the slit. In this manner, the fastening mechanism is in front of the user to ensure self wearing.

The present invention is a clothes protector system to be used by adults while sitting at a table and dining. It is designed for people who are living independently. It can be described as a system which is made from a piece of light weight cloth that is about 18 inches wide and about 36 inches long. The cloth has a neck hole which is about 6 inches in diameter. The neck hole starts about 2 inches from the top of the fabric and is centered with about 6 inches of fabric on each side. This will protect the clothing from the bottom of the chin, down the chest and across the lap. Note is also taken that the clothes protection system as described herein is reversible thus extending the utility of the invention.

The key to the design is the way it is fastened. The material is cut on the right side starting about 15 inches from the top of the fabric at an angle to the bottom of the beck hole. This will enable the person to put on the clothes protector system around the neck and fasten it with Velcro that is attached to each side of the cut. Having the fastener on the chest is key to the ease of use of the present invention. An individual may thus fasten and unfasten the Velcro without assistance.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A clothes protection system comprising:

a flexible sheet with a front and a back surface, the sheet also having a top and bottom edge with two side edges;

a neck hole with a lower most extent and an upper most extent;

a slit with upper and lower edges in a diagonal orientation extending from the lower most extent of the hole to one side edge forming an angle of between about 20 and 40 degrees from the horizontal; and a fastening assembly including a superior and an inferior strip, each strip having an inner face and an outer face with hook or loop fastening elements, the inferior strip secured to the exterior surface of the sheet adjacent to the lower edge of the slit, the superior strip secured to the back surface of the sheet adjacent to the upper edge of the slit.

2. The system as set forth in claim 1 wherein the sheet is fabricated of a material which is a flexible, washable material.

3. The system as set forth in claim 1 wherein the top edge and the bottom edge are spaced apart at a height of about 36 inches with the two side edges extending between the top and the bottom edges spaced apart at a width of about 18 inches.

4. The system as set forth in claim 1 wherein the hole has a diameter of about 6 inches.

5. The system as set forth in claim 1 and further including:

edging including an exterior edging covering the front and back surfaces of the sheet around the entire periphery of the sheet including the top and bottom and side edges with stitching securing the exterior edging to the sheet, the edging also including an interior edging covering the front and back surfaces around the entire neck hole and slit including the upper and lower edges of the slit with stitching securing the interior edging to the sheet.

6. A clothes protection system for independently keeping apparel of a wearer clean while eating comprising, in combination:

a flexible, washable sheet in a rectangular configuration with a front surface and a back surface, the sheet also having a horizontal top edge and a parallel bottom edge spaced apart at a height of about 36 inches with two parallel vertical side edges extending between the top and the bottom edges spaced apart at a width of about 18 inches, the sheet being fabricated of a flexible, washable material;

a neck hole in a circular configuration having a diameter of about 6 inches with a lower most extent located about 8 inches from the top edge and an upper most extent located about 2 inches from the top edge, the neck hole being centered between the two side edges;

a slit in a diagonal orientation extending from the lower most extent of the hole to one side edge about 15 inches from the top edge, the slit forming an upper edge and a lower edge, the slit and its edges forming an angle of about 30 degrees from the horizontal top and bottom edges;

edging including an exterior edging covering the front and back surfaces around the entire periphery of the sheet including the top and bottom and side edges with stitching securing the exterior edging to the sheet, the edging also including an interior edging covering the front and back surfaces around the entire neck hole and slit with stitching securing the interior edging to the sheet; and a fastening assembly including two hook and loop fastening strips, a superior strip and an inferior strip, each strip having stitching and an inner face and an outer face with hook and loop fastening elements, the inferior strip stitched to the front surface of the sheet adjacent to the lower edge of the slit, the superior strip stitched to the back surface of the sheet adjacent to the upper edge of the slit whereby a user is capable of observing the slit and the fastening assembly while putting on and taking off the system.

* * * * *